US012507848B2

(12) United States Patent
Dryden et al.

(10) Patent No.: US 12,507,848 B2
(45) Date of Patent: Dec. 30, 2025

(54) CLEANER HEAD FOR A VACUUM CLEANING APPLIANCE

(71) Applicant: Dyson Technology Limited, Wiltshire (GB)

(72) Inventors: Thomas Oliver Dryden, Bristol (GB); Michael Joseph Mathers, Bath (GB); Luke Patrick Stitson, Bristol (GB)

(73) Assignee: Dyson Technology Limited, Malmesbury (GB)

( * ) Notice: Subject to any disclaimer, the term of this patent is extended or adjusted under 35 U.S.C. 154(b) by 179 days.

(21) Appl. No.: 17/787,299

(22) PCT Filed: Oct. 14, 2020

(86) PCT No.: PCT/GB2020/052574
§ 371 (c)(1),
(2) Date: Jun. 18, 2022

(87) PCT Pub. No.: WO2021/130465
PCT Pub. Date: Jul. 1, 2021

(65) Prior Publication Data

US 2023/0015856 A1 Jan. 19, 2023

(30) Foreign Application Priority Data

Dec. 23, 2019 (GB) ..... 1919146

(51) Int. Cl.
*A47L 9/04* (2006.01)
*A47L 11/40* (2006.01)

(52) U.S. Cl.
CPC ..... *A47L 9/0477* (2013.01); *A47L 9/0411* (2013.01); *A47L 11/4036* (2013.01)

(58) Field of Classification Search
CPC ..... A47L 9/0477; A47L 9/0411; A47L 9/04; A47L 9/0461; A47L 11/4041; A47L 9/0693; A47L 11/4036
(Continued)

(56) References Cited

U.S. PATENT DOCUMENTS 1,265,791 A * 5/1918 Kirby ..... A47L 9/0422 15/388
1,318,881 A * 10/1919 Kelley ..... A47L 5/34 15/411
(Continued)

FOREIGN PATENT DOCUMENTS

CN 101557748 A 10/2009
CN 102551597 A 7/2012
(Continued)

OTHER PUBLICATIONS

GB-2520549-A espacenet (Year: 2024).*
(Continued)

*Primary Examiner* — Andrew A Horton
(74) *Attorney, Agent, or Firm* — Tucker Ellis LLP

(57) ABSTRACT

A cleaner head for a vacuum cleaning appliance includes an agitator assembly including a cylindrical body configured to rotate about its longitudinal axis; a main body defining an agitator chamber within which is supported the agitator assembly and a suction opening through which a portion of the agitator assembly engages a surface to be cleaned. The main body has opposing ends and a first exhaust channel in fluid communication with the agitator chamber. The main body is configured such that the cross-sectional area of the agitator chamber increases in a direction from one of the opposing ends of the agitator chamber towards the first exhaust channel.

20 Claims, 13 Drawing Sheets

(58) Field of Classification Search
USPC ..... 15/383, 363, 389, 390, 391, 392
See application file for complete search history.

(56) References Cited

U.S. PATENT DOCUMENTS

| | | | | | |
|---|---|---|---|---|---|
| 1,550,198 | A * | 8/1925 | Bobst | A47L 9/04 | 15/368 |
| 1,714,497 | A * | 5/1929 | Codrick | A47L 5/30 | 15/340.3 |
| 1,965,614 | A * | 7/1934 | Sellers | A47L 5/34 | 15/375 |
| 2,100,089 | A * | 11/1937 | Smellie | A47L 9/0416 | 15/363 |
| 2,134,396 | A * | 10/1938 | Campbell | A47L 5/34 | 15/348 |
| 2,176,467 | A * | 10/1939 | Milner, Jr. | A47L 5/30 | 55/369 |
| 2,620,506 | A * | 12/1952 | Weiland | A47L 9/0653 | 15/325 |
| 3,049,744 | A * | 8/1962 | Macfarland | A47L 5/30 | 362/91 |
| 5,077,863 | A * | 1/1992 | Rench | A47L 9/0411 | 15/384 |
| 6,345,408 | B1 * | 2/2002 | Nagai | A47L 9/327 | 15/361 |
| 6,473,934 | B2 * | 11/2002 | Lijzenga | A47L 9/0653 | 15/373 |
| 10,327,619 | B2 * | 6/2019 | Moser | A47L 11/4016 | |
| 2004/0168282 | A1 | 9/2004 | Hitzelberger et al. | | |
| 2006/0000053 | A1 * | 1/2006 | Lim | A47L 9/02 | 15/415.1 |
| 2008/0148512 | A1 | 6/2008 | Beskow et al. | | |
| 2008/0209671 | A1 * | 9/2008 | Conrad | A47L 9/02 | 15/349 |
| 2012/0011680 | A1 * | 1/2012 | Owen | A47L 9/04 | 15/383 |
| 2012/0151713 | A1 * | 6/2012 | Krebs | A47L 9/0626 | 15/415.1 |
| 2013/0086769 | A1 * | 4/2013 | Iles | A47L 9/0444 | 15/363 |
| 2013/0205539 | A1 * | 8/2013 | Dyson | A47L 9/0477 | 15/389 |
| 2015/0320278 | A1 * | 11/2015 | Hyun | A47L 9/0411 | 15/383 |
| 2017/0215679 | A1 * | 8/2017 | Moser | A47L 11/4016 | |
| 2018/0192836 | A1 * | 7/2018 | Dodgson | A47L 9/0411 | |
| 2020/0221914 | A1 * | 7/2020 | Kim | A47L 9/02 | |

FOREIGN PATENT DOCUMENTS

| | | | | |
|---|---|---|---|---|
| CN | 108478104 | A | 9/2018 | |
| CN | 108903798 | A | 11/2018 | |
| CN | 209421834 | U | 9/2019 | |
| DE | 2949961 | A1 | 6/1981 | |
| GB | 2520549 | A * | 5/2015 | A47L 9/02 |
| JP | 2006-015112 | A | 1/2006 | |
| JP | 2012-035127 | A | 2/2012 | |
| JP | 2018-086299 | A | 6/2018 | |

OTHER PUBLICATIONS

American Dictionary of the English Language, definition of conical, https://websterdictionary1828.com/Dictionary/conical (Year: 2024).*

Office Action received for Chinese Patent Application No. 202080084074.1, mailed on Feb. 3, 2023, 22 pages (13 pages of English Translation and 9 pages of Original Document).

Office Action received for Japanese Patent Application No. 2022-538878, mailed on Dec. 5, 2023, 5 pages (3 pages of English Translation and 2 pages of Original Document).

International Search Report and Written Opinion received for PCT Patent Application No. PCT/GB2020/052574, mailed on Jan. 15, 2021, 9 pages.

Search Report received for GB Application No. 1919146.9, mailed on Jun. 22, 2020, 1 page.

Office Action received for Japanese Patent Application No. 2022-538878, mailed on Jul. 26, 2023, 8 pages (5 pages of English Translation and 3 pages of Original Document).

* cited by examiner

CLEANER HEAD FOR A VACUUM CLEANING APPLIANCE

RELATED APPLICATION DATA

This application is the National Stage of International Application No. PCT/GB2020/052574 filed Oct. 14, 2020, and claims benefit of United Kingdom Application No. 1919146.9 filed Dec. 23, 2019, each of which are herein incorporated by reference in their entirety.

TECHNICAL FIELD

The invention relates generally to vacuum cleaner appliances, and particularly to a cleaner head which forms part of the appliances.

BACKGROUND

A vacuum cleaning appliance or, more simply, "vacuum cleaner", typically comprises a main body, equipped with a suction source and a dust separator, and a cleaner head connected to the dust separator usually by a separable coupling. The cleaner head has a suction opening with which it engages a surface to be cleaned and through which dirt-laden air is drawn into the vacuum cleaner towards the dust separator. The cleaner head performs a crucial role in the effectiveness of a vacuum cleaner in removing dirt from a surface, whether that surface is a hard floor covering such as wood or stone, or a soft floor covering such as carpet. Therefore, much effort is made by vacuum cleaner manufacturers to optimise cleaner head design to improve performance.

A significant design challenge is to optimise the way in which air flows through the cleaner head, from where air enters its interior, through the suction opening, to where air is discharged from an outlet towards the dust separator. It is known that air flow velocity is an important factor in pick-up performance since dirt particles are transported more effectively when the velocity of air moving through the tool is high. However, maintaining a high flow velocity is not straightforward and generally correlates to high energy consumption. This is generally undesirable due to the drive towards energy efficient machines, and has particular relevance to battery powered vacuum cleaners where energy efficiency has a direct effect on available runtime. It is desirable therefore to use a cleaner head that enables a low flow velocity to be used without compromising on its performance.

It is against this background that the invention has been devised.

SUMMARY OF THE INVENTION

According to an aspect of the invention, there is provided a cleaner head for a vacuum cleaning appliance, the cleaner head comprising an agitator assembly comprising a cylindrical body configured to rotate about its longitudinal axis; a main body defining an agitator chamber within which is supported the agitator assembly and a suction opening through which a portion of the agitator assembly engages a surface to be cleaned, the main body having opposing ends; and, a first exhaust channel in fluid communication with the agitator chamber, wherein the main body is configured such that the cross-sectional area of the agitator chamber increases in a direction from one of the opposing ends of the agitator chamber towards the first exhaust channel. This arrangement imparts a lateral component on the trajectories of the dirt particles that interact with the interior surface of the agitator chamber, guiding them towards the first exhaust channel.

Preferably, the cross-sectional area of the agitator chamber increases in directions from both of the opposing ends of the agitator chamber towards the first exhaust channel.

Preferably, the cross-section of the agitator chamber about its longitudinal axis is substantially circular. This arrangement ensures that the lateral component added to the trajectories of the dirt particles travelling across the interior surface of the agitator chamber is consistent with respect to a lateral position within the agitator chamber regardless of whether they are traversing an upper, front or rear segment of the agitator chamber at that position.

Preferably, the main body is configured such that the cross-sectional area of the agitator chamber increases continuously. This arrangement adds a uniform lateral component to the trajectories of the dirt particles.

Alternatively, the main body may be configured such that the cross-sectional area of the agitator chamber increases at a decreasing rate. This arrangement provides greater curvature nearer to the opposing ends, comparatively increasing the lateral component that is added to the trajectories of the dirt particles at the opposing ends.

Preferably, the main body is configured such that the cross-sectional area of the agitator chamber increases from at least one of the opposing ends to the first exhaust channel.

Preferably, the first exhaust channel extends tangentially from the agitator chamber, providing a seamless or unbroken merger between the interior surface of the agitator chamber and an interior surface of the exhaust channel. This allows the dirt particles to be directed to the first exhaust channel using only the interior surface of the agitator chamber, making their trajectory through the agitator chamber largely independent of the air flow through the cleaner head.

Preferably, the first exhaust channel is substantially perpendicular with respect to a horizontal plane.

Preferably, the agitator assembly is configured to rotate about its longitudinal axis to sweep dirt particles from the surface to be cleaned towards a rear section of the agitator chamber with respect to a forward direction of the cleaner head during use, and wherein the first exhaust channel extends vertically from the rear section of the agitator chamber.

As an alternative option, the first exhaust channel extends substantially parallel with respect to a horizontal plane.

Preferably, the agitator assembly is configured to rotate about its longitudinal axis to sweep dirt particles from the surface to be cleaned towards a front section of the agitator chamber with respect to a forward direction of the cleaner head during use, and wherein the first exhaust channel extends rearward from an upper section of the agitator chamber.

Preferably, the first exhaust outlet is located at a mid-point between the opposing ends of the agitator chamber. This arrangement minimises the collective distance travelled by the dirt particles within the agitator chamber.

Preferably, the cleaner head further comprises a rib extending radially inward from an interior surface of the agitator chamber and laterally positioned within the agitator chamber at a point where the first exhaust channel and the agitator chamber meet. The rib acts as a barrier preventing dirt particles that have entered one side of the agitator chamber from traversing too far across the interior surface of the agitator chamber before they exit the agitator chamber through the exhaust channel. This minimises the number of times that the dirt particles can recirculate within the agitator chamber, reducing the risk of the dirt particles being returned to the floor surface.

Preferably, the cleaner head further comprises a duct protruding from the first exhaust channel into the agitator chamber. This arrangement extends the first exhaust channel into the agitator chamber to capture those dirt particles whose trajectories would have otherwise taken them outside the width of the first exhaust channel, and so prevents their recirculation within the agitator chamber.

Preferably, the agitator chamber defines a double-conical chamber.

Alternatively, the cleaner head further comprises a second exhaust channel and the agitator chamber defines two double-conical chambers in an end-to-end arrangement, with the first exhaust channel corresponding to one of the two double-conical chambers and the second exhaust channel corresponding to the other of the two double-conical chambers.

According to a further aspect of the invention, there is provided a vacuum cleaning appliance comprising a cleaner head according to the previous aspect.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

The above and other aspects of the invention will now be described, by way of example only, with reference to the accompanying drawings, in which.

Figure 1:
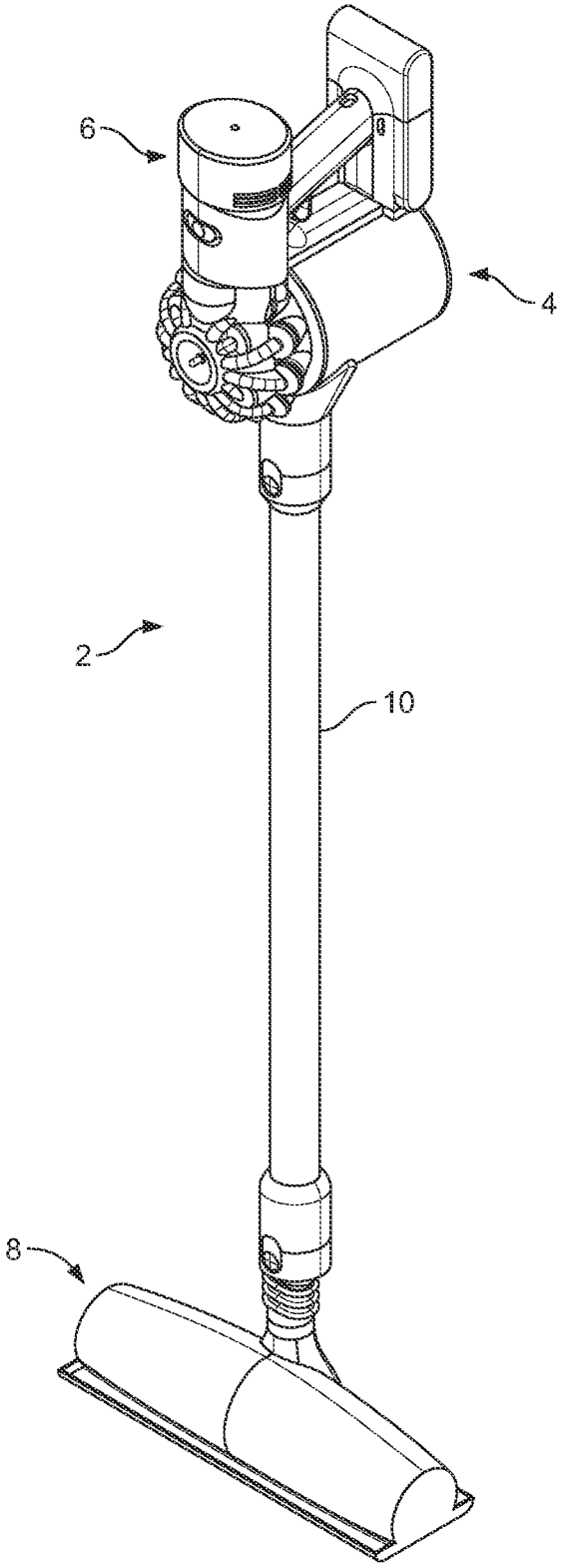
FIG. 1 is a front perspective view of a vacuum cleaning appliance comprising a cleaner head in accordance with an embodiment of the invention.

In the drawings, like feature are denoted by like reference signs where appropriate.

SPECIFIC DESCRIPTION

Specific embodiments of the invention will now be described in which numerous features will be discussed in detail in order to provide a thorough understanding of the inventive concept as defined in the appended claims. However, it will be apparent to the reader that the invention may be put in to effect without the specific details and that, in some instances, well known methods, techniques and structures have not been described in detail in order not to obscure the inventive concept unnecessarily.

FIG. 1 shows a vacuum cleaning appliance or vacuum cleaner 2 comprising a dirt and dust separating unit 4, a motor-driven fan unit 6 and a cleaner head 8 in accordance with an embodiment of the invention. The vacuum cleaner 2 further comprises a wand 10 connecting the dirt and dust separating unit 4 and the cleaner head 8. The motor-driven fan unit 6 draws dirt-bearing air through the cleaner head 8, from a surface to be cleaned, such as a floor surface, to the dirt and dust separating unit 4, where dirt and dust particles are separated from the dirt-bearing air and the comparatively clean air is expelled from the vacuum cleaner 2. The dirt and dust separating unit 4 shown in this example is a cyclonic separating unit. However, the type of separating unit is not material to the invention and the reader will understand that an alternative separating unit or a combination of different separating units could be used. Similarly, the vacuum cleaner 2 shown in FIG. 1 is a so-called stick vacuum cleaner but the nature of the vacuum cleaner is not important for the inventive concept, and so the reader will understand that the various embodiments of the cleaner head 8 disclosed herein may be used with other types of vacuum cleaners such as, for example, upright or cylinder vacuum cleaners.

Figure 2:
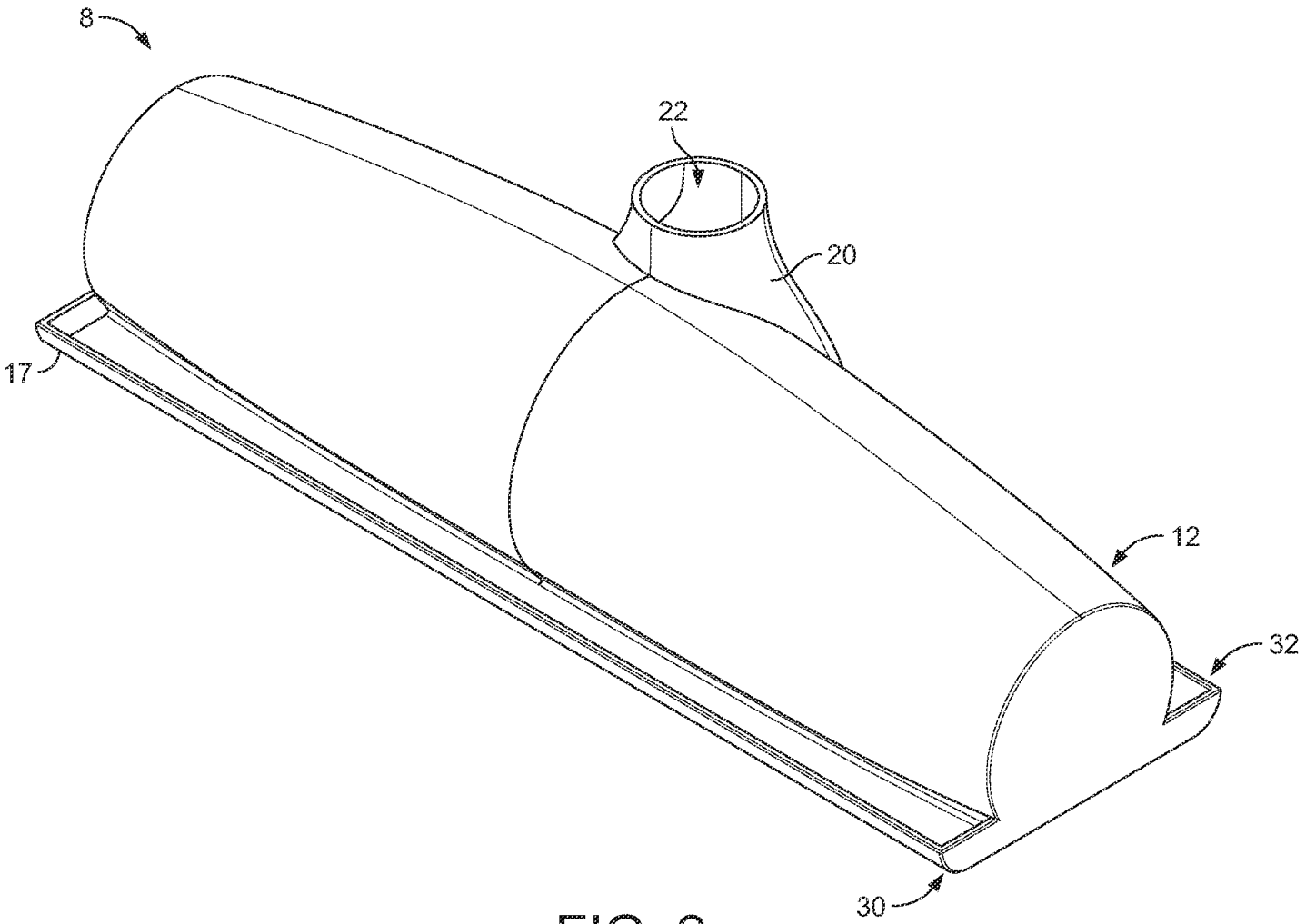
FIG. 2 is a front perspective view of the cleaner head of FIG. 1.
Figure 3:
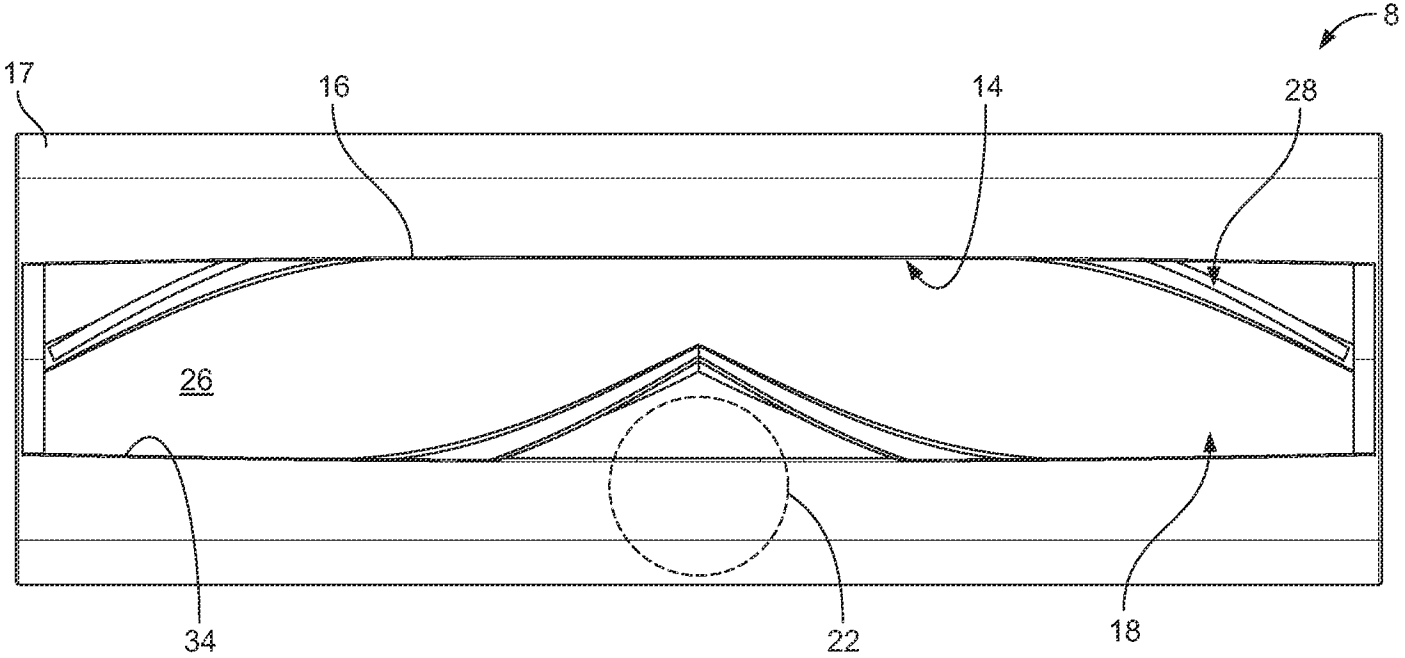
FIG. 3 is a bottom view of the cleaner head of FIG. 1.

With reference to FIGS. 2 and 3, the cleaner head 8 includes a main body 12 defining an agitator chamber 14, along with a generally rectangular suction opening 16, located in a flat supporting surface 17 of the main body 12. The suction opening 16 is in fluid communication with the agitator chamber 14. The cleaner head 8 further includes an agitator assembly 18, rotatably mounted within the agitator chamber 14, and an outlet duct 20 forming an exhaust channel 22 located, in this example, at a rear end 32 of the main body 12. As with the suction opening 16, the exhaust channel 22 is in fluid communication with the agitator chamber 14 such that, during use, dirt-bearing air is able to flow through the cleaner head 8 from the suction opening 16 to the exhaust channel 22.

The agitator assembly 18 is arranged transversely within the agitator chamber 14 such that it is perpendicular to the direction of travel of the cleaner head 8 during use, and comprises a cylindrical body 26 appropriately mounted within the agitator chamber 14 to be rotatable about its longitudinal axis. In this embodiment, the cylindrical body 26 houses an electric motor and a drive mechanism, which connects the agitator assembly 18 to the electric motor for driving the cylindrical body 26 about its longitudinal axis. Such drive arrangements are known, and so will not be explained in further detail and it should be appreciated that alternative drive arrangements may be used. The agitator assembly 18 further comprises a plurality of agitator rows 28 extending from an outer surface of the cylindrical body 26. The agitator rows 28 may include one or more of a plurality of soft filaments, having tips that can flex relative to the cylindrical body 26 upon contact with the floor surface, stiff bristles or a strip of continuous material, and may be made of carbon fibre or nylon, to name two common material examples. In this embodiment, the agitator rows 28 extend along the outer surface of the cylindrical body 26 in a so-called chevron formation, where opposing agitator rows 28 extend, at an angle, from opposite sides of the cylindrical body 26 to meet at its centre. In another embodiment, the agitator rows 28 may be arranged in a helical formation, with each of the agitator rows 28 extending through 360° about the outer surface of the cylindrical body 26. Regardless of formation, however, the agitator assembly 18 is arranged so that at the agitator rows 28 act through the suction opening 16 with the rotation of the cylindrical body 26 to sweep dirt and dust particles (hereinafter, "dirt particles"), together with other debris, from both a hard floor surface and a carpeted surface into the agitator chamber 14. In this embodiment, the agitator assembly 18 is configured to rotate about its longitudinal axis to sweep the agitator rows 28 over the floor surface rearwardly, in a direction from a front end 30 of the main body 12 to its rear end 32. This way, dirt particles are swept from the floor surface towards a rear section 34 of the agitator chamber 14.

Figure 4:
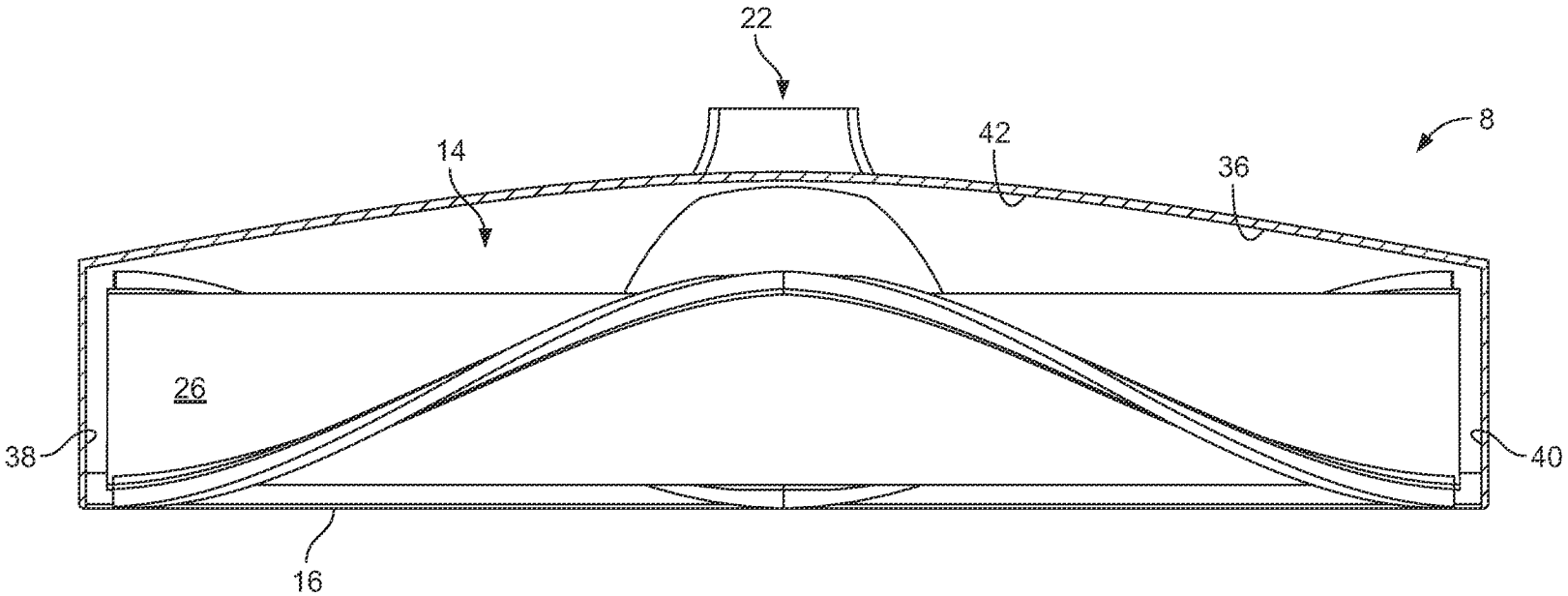
FIG. 4 is a front sectional view of the cleaner head of FIG. 1.
Figure 5:
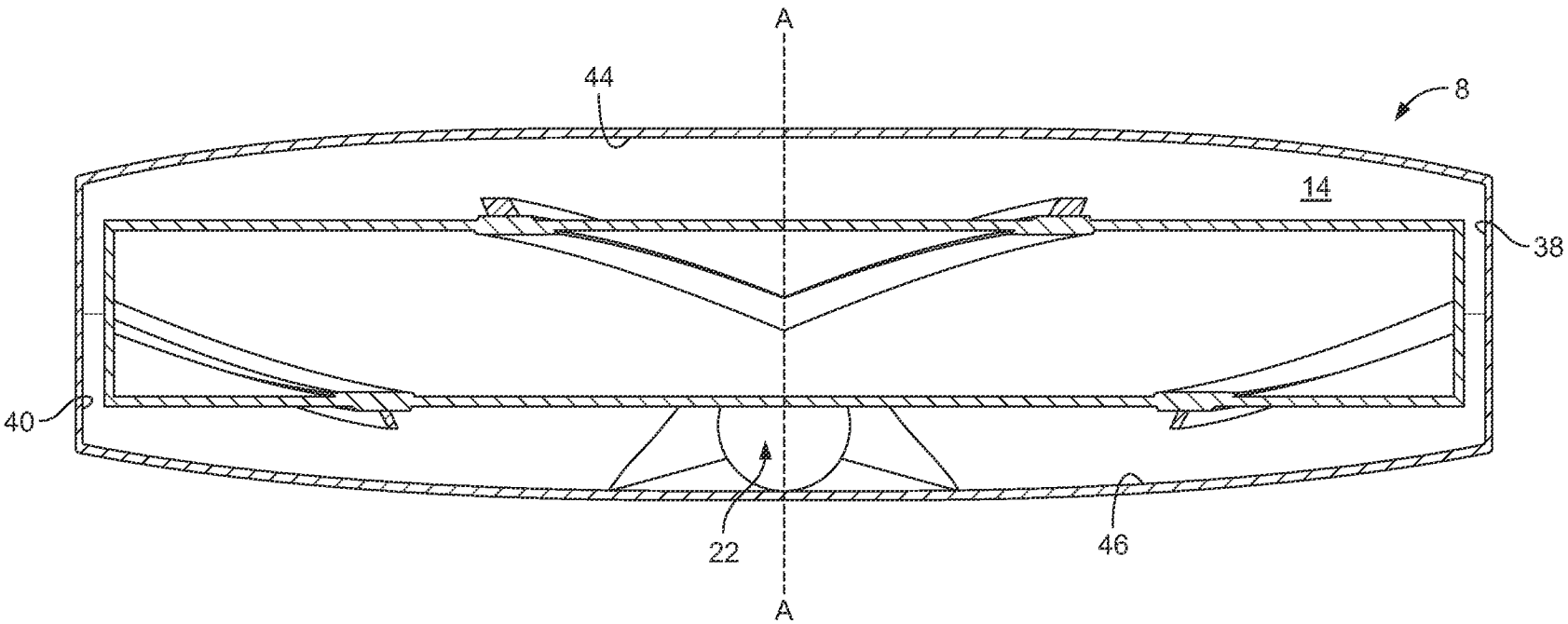
FIG. 5 is an upper sectional view of the cleaner head of FIG. 1.

With reference to FIGS. 4 and 5, an interior surface 36 of the agitator chamber 14 generally comprises upper, front and rear segments 42, 44, 46 that diverge in directions from opposing ends 38, 40 of the agitator chamber 14 to the exhaust channel 22 to define a substantially double-conical chamber whose cross-sectional area increases towards the exhaust channel 22. In the present embodiment, the interior surface 36 diverges along the entire length between the opposing ends 38, 40 of the agitator chamber 14 and the exhaust channel 22 is located in the middle of the agitator chamber 14, defined at a mid-point between the opposing ends 38, 40.

Turning to FIG. 4, the height of the agitator chamber 14, defined by the upper segment 42 of the interior surface 36, increases in directions from the opposing ends 38, 40 towards the centrally located exhaust channel 22. This configuration increases the cross-sectional area of the agitator chamber 14 towards the exhaust channel 22, providing an expanding path for dirt particles to trace along the interior surface 36 of the agitator chamber 14 from the suction opening 16 to the exhaust channel 22. The upper segment 42 defines a concave surface, the characteristics of which determine the rate at which the cross-sectional area of the agitator chamber 14 increases towards the exhaust channel 22. In the present embodiment, the curvature of the upper segment 42 is greatest near to the opposing ends 38, 40 and decreases towards the exhaust channel 22. As a result, the cross-sectional area of the agitator chamber 14 increases at a decreasing rate in directions from the opposing ends 38, 40 towards the exhaust channel 22. Varying the curvature, and so the rate at which the cross-sectional area of the agitator chamber 14 increases, is particularly advantageous as it adds a lateral component to the trajectories that the dirt particles trace across the interior surface 36 of the agitator chamber 14 that depends on the point at which they enter the agitator chamber 14, as will be described later in more detail.

Turning to FIG. 5, which is a section view of the cleaner head 8 in a horizontal plane, the front and rear segments 44, 46 of the interior surface 36 of the agitator chamber 14 also define concave surfaces that diverge in directions from the opposing ends 38, 40 towards the mid-point of the agitator chamber 14, thereby contributing to the overall increase in the cross-sectional area of the agitator chamber 14 from the opposing end 38, 40 towards the exhaust channel 22. In this embodiment, the respective curvatures of the front and rear segments 44, 46 is greatest near to the opposing ends 38, 40 and decreases towards the mid-point of the agitator chamber 14 to define a substantially flat surface. This arrangement means that the cross-section of the agitator chamber 14 is substantially circular along its entire length, ensuring that the lateral component added to the trajectories of the dirt particles travelling across the interior surface 36 is consistent with respect to a lateral position within the agitator chamber 14 regardless of whether they are traversing the upper, front or rear segment 42, 44, 46 at that position.

Figure 6:
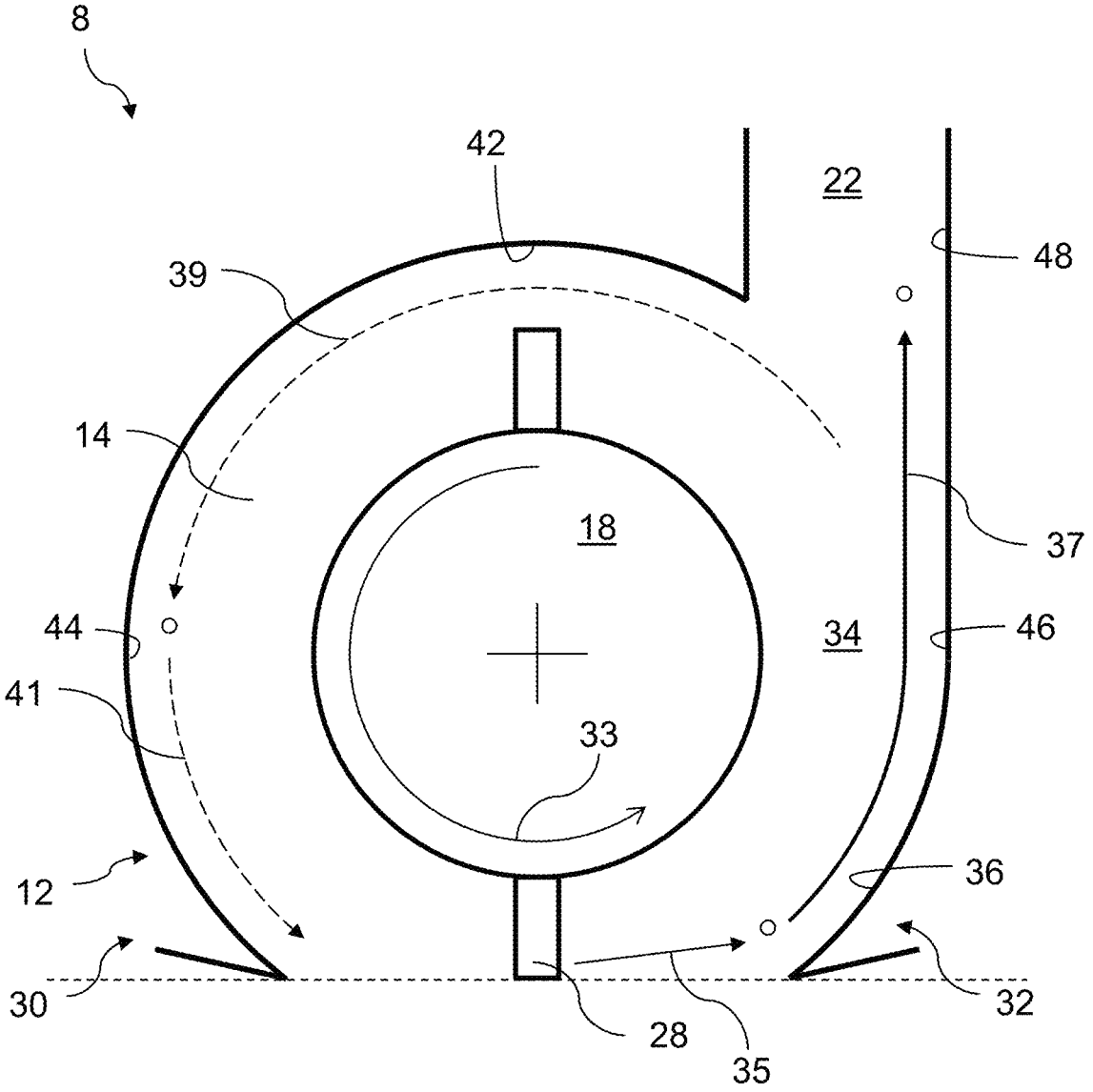
FIG. 6 is a sectional view of the cleaner head of FIG. 1 along section A-A shown in FIG. 5.

FIG. 6 is a sectional view at the mid-point of the agitator chamber 14 in a vertical plane showing dirt particles that have entered the agitator chamber 14 along the centre of the suction opening 16, having been rearwardly swept from the floor surface by rotation 33 of the agitator assembly 18 and accelerated towards the rear section 34 of the agitator chamber 14. The energised dirt particles move radially outwards 35, with respect to the longitudinal axis of the agitator assembly 18, under the influence of a force produced by their acceleration, to the interior surface 36 of the agitator chamber 14 where their trajectories 37, 39, 41 are defined according to the curvature of the interior surface 36. The energised dirt particles pass thorough the rear section 34 of the agitator chamber 14 to reach the rear segment 46 of the interior surface 36. At this point of the agitator chamber 14, the rear segment 46 is substantially flat in the horizontal plane and therefore imparts little to no lateral component on the trajectories of the dirt particles interacting therewith. Instead, the dirt particles follow the circular segment profile of the rear segment 46 in the vertical plane upward towards the exhaust channel 22, which extends tangentially from the agitator chamber 14 in a vertical direction. That is, the exhaust channel 22 extends directly from the agitator chamber 14 in a direction perpendicular to the horizontal plane. Provided that the upward trajectories 37 of the dirt particles take them to within the width of the exhaust channel 22, they will travel up the exhaust channel 22, along with the air drawn by the motor-driven fan unit 6, to the dirt and dust separating unit 4. Those dirt particles whose trajectories 39, 41 take them outside the width of the exhaust channel 22 will be directed to the upper segment 42 of the interior surface 36 of the agitator chamber 14, from where they will be recirculated within the agitator chamber 14 until they eventually leave through the exhaust channel 22.

The purpose of arranging the exhaust channel 22 tangentially with respect to the agitator chamber 14 is that it provides a seamless or unbroken merger between the interior surface 36 of the agitator chamber 14 and an interior surface 48 of the exhaust channel 22. This allows the energised dirt particles, under the influence of the force produced by the agitator assembly 18, to be directed to the exhaust channel 22 using only the interior surface 36 of the agitator chamber 14, making their trajectory 37, 39, 41 through the agitator chamber 14 largely independent of the air flow through the cleaner head 8. This arrangement goes against known cleaner heads, which are configured to hold dirt particles that have been energised by an agitator assembly within a chamber through a series of collisions to dissipate their kinetic energy until it is low enough for them to become entrained within the air flow through the cleaner head. In contrast, all of the embodiments of the present invention aim to minimise the number of collisions that the energised dirt particles experience inside the cleaner head 8 in order not to waste their kinetic energy but instead to use it to guide the dirt particles towards and through the exhaust channel 22. This not only improves the evacuation of the dirt particles from the cleaner head 8 but also presents an opportunity to lower the air flow velocity through the cleaner head 8, and so reduce power consumption of the motor-driven fan unit 6.

Figure 7:
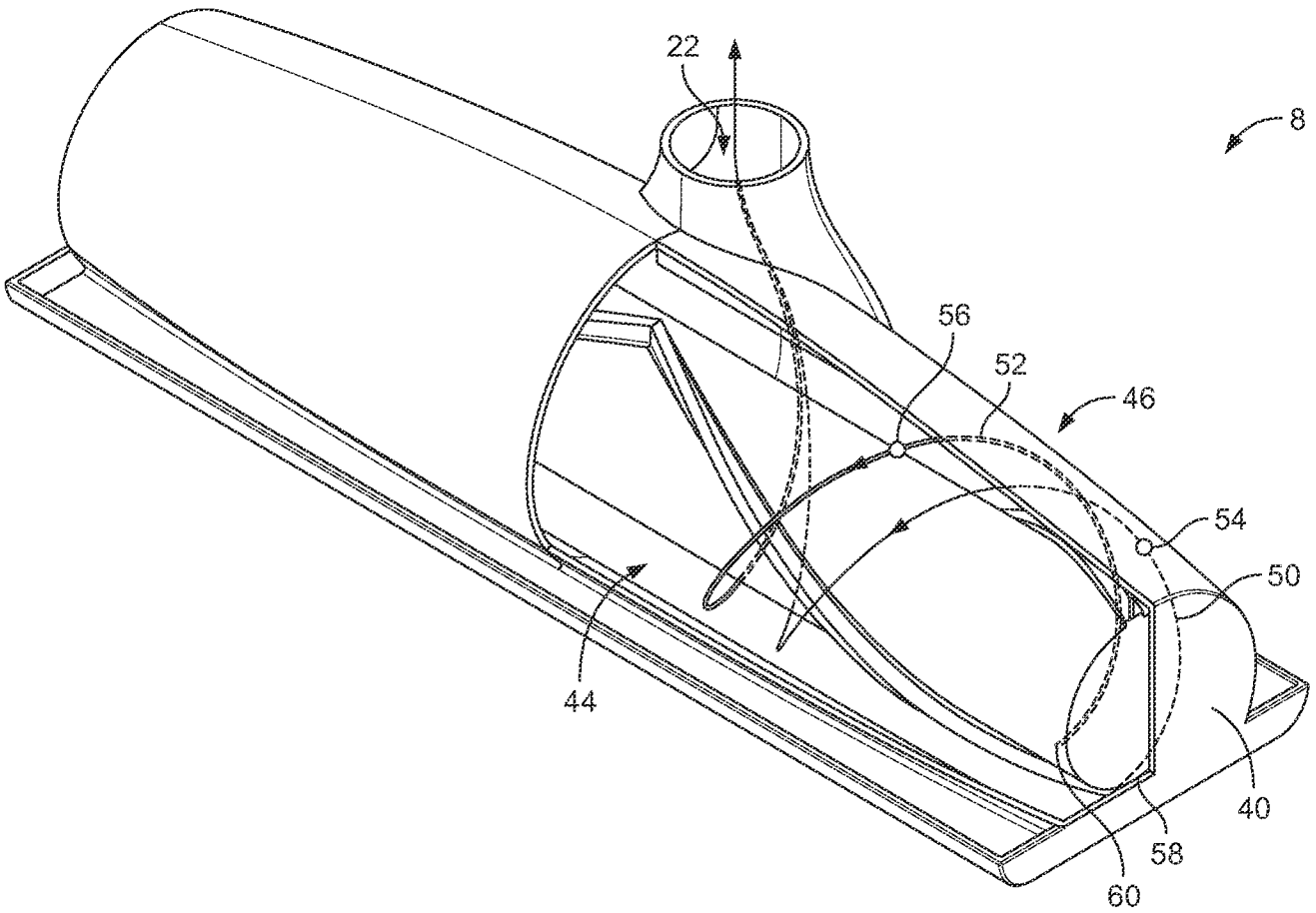
FIG. 7 is a front perspective view of the cleaner head of FIG. 1 with a right section of its main body cutaway.

FIG. 7 illustrates respective paths 50, 52 that first and second dirt particles 54, 56 might take along the interior surface 36 of the agitator chamber 14 to the exhaust channel 22. The first and second dirt particles 54, 56 enter the agitator chamber 14 at a first lateral position 58, located near to one of the opposing ends 38, 40 of the agitator chamber 14, and a second lateral position 60, located approximately mid-way between the centre of the suction opening 16 and the first point 58. As mentioned above, the cross-sectional area of the agitator chamber 14 increases in a direction from the opposing ends 38, 40 of the agitator chamber 14 towards the exhaust channel 22 owing to the divergent arrangement of the upper, front and rear segments 42, 44, 46 of the interior surface 36 of the agitator chamber 14. This divergence adds a lateral component to the trajectories of dirt particles upon their interaction with the rear segment 46 of the interior surface 36 of the agitator chamber 14, having been rearwardly swept from the floor surface by the agitator assembly 18, to direct them in a spiral path towards the centre of the agitator chamber 14, and so, in this embodiment, the exhaust channel 22. The size of the lateral component that is added to the trajectory of a dirt particle is initially dependent on the curvature of the rear segment 46 at the point at which the dirt particle enters the agitator chamber 14, and subsequently on the curvatures of the upper and front segments 42, 44. The curvatures of the upper, front and rear segments 42, 44, 46 at the first lateral position 58, located near to one of the opposing ends 38, 40, is greater than their curvatures at the second lateral position 60, which is more centrally located. The trajectory of the first dirt particle 54 entering the agitator chamber 14 at the first lateral position 58, and any other dirt particles traversing the interior surface 36 of the agitator chamber 14 at that position, therefore, will comprise a greater lateral component comparative to the trajectory of the second dirt particle 56 entering the agitator chamber 14 at the second lateral position 60, meaning that they initially traverse a comparatively great lateral distance per revolution of the agitator chamber 14. This arrangement provides an elongate spiral path 50 to the exhaust channel 22 for dirt particles entering the agitator chamber 14 near to the opposing ends 38, 40 and a more uniform spiral path 52 for those dirt particles entering the agitator chamber 14 nearer to its mid-point. In both cases, however, the paths 50, 52 are arranged to minimise recirculation of dirt particles within the agitator chamber 14 regardless of the lateral position at which they enter the agitator chamber 14 in order to reduce the possibility of the dirt particles returning to the floor surface. For simplicity, this figure illustrates the spiral paths 50, 52 of just two dirt particles 54, 56 entering the right-hand side of the agitator chamber 14 but the reader will understand that, in practice, many more dirt particles will enter both the right- and left-hand sides of the agitator chamber 14 and spiral towards the exhaust outlet 22.

Figure 8:
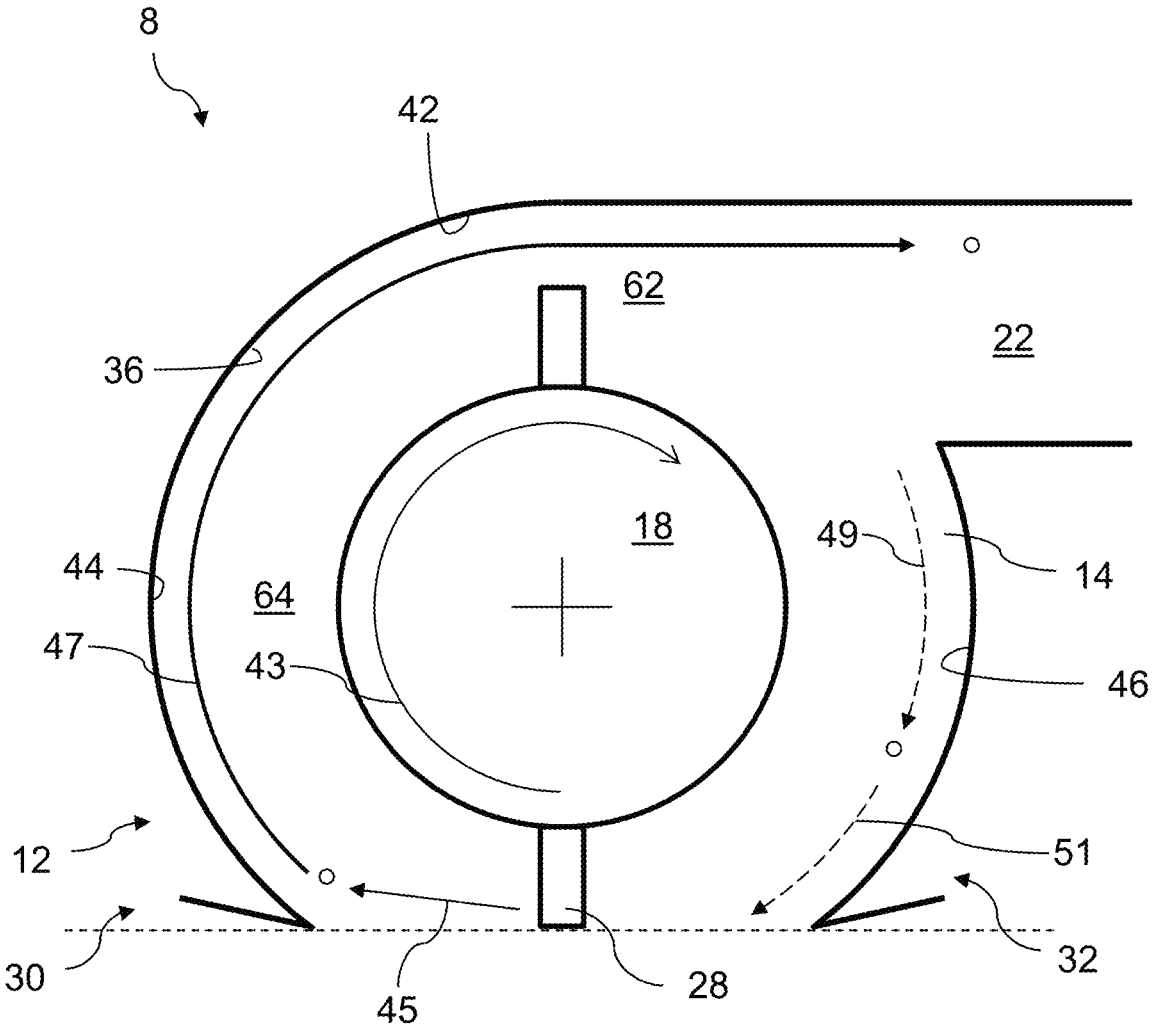
FIG. 8 is a sectional view of another embodiment of the cleaner head along a section equivalent to section A-A shown in FIG. 5.

FIG. 8 is a sectional view of a cleaner head 8 at the mid-point of an agitator chamber 14 in the vertical plane according to another embodiment of the invention. This embodiment of the cleaner head 8 is substantially the same as the previous embodiment save two features: first, the exhaust channel 22, instead of extending tangentially from the agitator chamber 14 in a vertical direction as in the previous embodiment, extends tangentially from an upper section 62 of the agitator chamber 14 in a substantially horizontal placement towards the rear end 32 of the main body 12; and, second, in this embodiment, the agitator assembly 18 is configured to rotate 43 about its longitudinal axis to sweep the agitator rows 28 over the floor surface forwardly; that is, from the rear end 32 of the main body 12 to the front end 30. This way, dirt particles are swept from the floor surface and are accelerated towards a front section 64 of the agitator chamber 14.

The energised dirt particles move radially outwards 45, with respect to the longitudinal axis of the agitator assembly 18, under the influence of a force produced by their acceleration, to pass thorough the front section 64 of the agitator chamber 14 to reach the front segment 44 of the interior surface 36. At this point of the agitator chamber 14 (i.e. the mid-point), the front segment 44 is substantially flat or without significant curvature in the horizontal plane and therefore imparts little to no lateral component on the trajectories 47, 49, 51 of the dirt particles interacting therewith. Instead, the dirt particles follow the circular segment profile of the front segment 44 in the vertical plane upward towards the upper segment 42 and, following the boundary defined by the interior surface 36, subsequently rearward towards the exhaust channel 22, which extends tangentially from the upper section 62 of agitator chamber 14 in a substantially horizontal, rearward direction. Provided that the rearward trajectories 47 of the dirt particles take them to within the width of the exhaust channel 22, they will travel along the exhaust channel 22, along with the air drawn by the motor-driven fan unit 6, on to the dirt and dust separating unit 4. Those dirt particles whose trajectories 49, 51 take them outside the width of the exhaust channel 22 will be directed to the rear segment 46 of the interior surface 36 of the agitator chamber 14, from where they will be recirculated within the agitator chamber 14 until they eventually leave through the exhaust channel 22.

Figure 9:
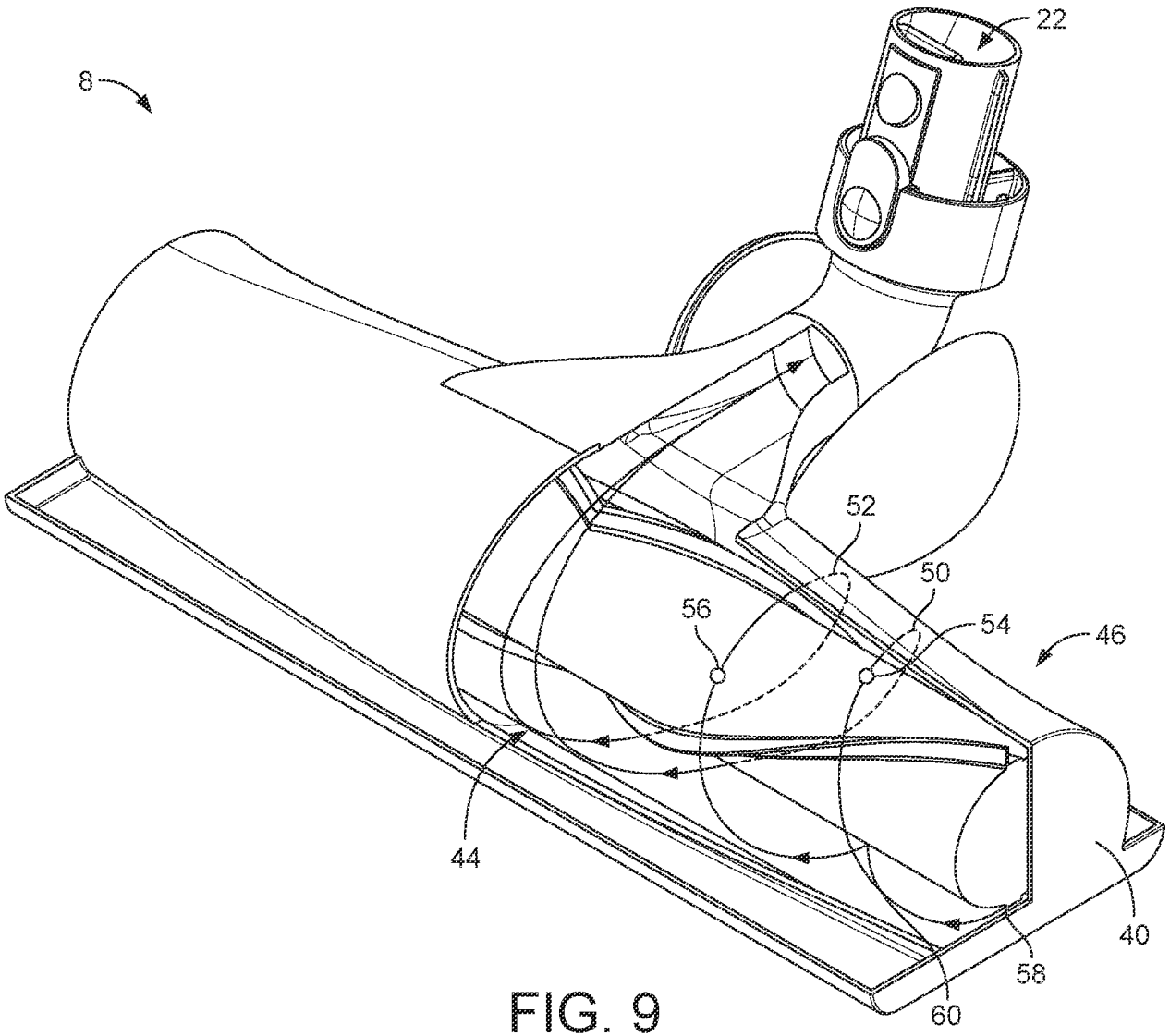
FIG. 9 is a front perspective view of the cleaner head of FIG. 8 with a right section of its main body cutaway.

Turning to FIG. 9, which illustrates respective paths 50, 52 that first and second dirt particles 54, 56 might take along the interior surface 36 of the agitator chamber 14 to the exhaust channel 22, the first and second dirt particles 54, 56 enter the agitator chamber 14 at first and second lateral positions 58, 60 respectively. As is the case with the previous embodiment, the cross-sectional area of the agitator chamber 14 of this embodiment of the cleaner head 8 increases in directions from the opposing ends 38, 40 of the agitator chamber 14 towards the exhaust channel 22 owing to the divergent arrangement of the upper, front and rear segments 42, 44, 46 of the interior surface 36 of the agitator chamber 14. This divergence adds a lateral component to the trajectories of dirt particles upon their interaction with the front segment 44 of the agitator chamber 14, having been forwardly swept from the floor surface by the agitator assembly 18, to direct them in a cone spiral path towards the centre of the agitator chamber 14, and so the exhaust channel 22. The size of the lateral component that is added to the trajectories of a dirt particle is initially dependent on the curvature of the front segment 44 at the point at which the dirt particle enters the agitator chamber 14, and subsequently on the curvatures of the upper and rear segments 42, 46. The curvatures of the upper, front and rear segments 42, 44, 46 at the first lateral position 58, located near to one of the opposing ends 38, 40, is greater than their curvatures at the second lateral position 60, which is more centrally located. So, as with the previous embodiment, the trajectory of the first dirt particle 54 entering the agitator chamber 14 at the first lateral position 58 comprises a greater lateral component comparative to the trajectory of the second dirt particle 56 entering the agitator chamber 14 at the second lateral position 60. This means that dirt particles entering or traversing the agitator chamber 14 at the first lateral position 58 initially traverse a comparatively great lateral distance per revolution of the agitator chamber 14 when compared to dirt particles entering the agitator chamber 14 at the second lateral position 60. This arrangement provides an elongate spiral path 50 to the exhaust channel 22 for dirt particles entering the agitator chamber 14 near to the opposing ends 38, 40 and a more uniform spiral path 52 for those dirt particles entering the agitator chamber 14 near to its mid-point. In both cases, however, the paths 50, 52 are arranged to minimise recirculation of dirt particles within the agitator chamber 14 regardless of the lateral position at which they enter the agitator chamber 14 in order to reduce the possibility of the dirt particles returning to the floor surface.

In both of the embodiments of the cleaner head 8 described above, the cross-sectional area of the agitator chamber 14 increases in directions from opposing ends 38, 40 of the agitator chamber 14 towards the exhaust channel 22. However, many modifications may be made to the above embodiments without departing from the scope of the present invention as defined in the accompanying claims.

For example, the respective curvatures of the upper, front and rear segments 42, 44, 46 of the interior surface 36 of the agitator chamber 14 may be the same at any lateral position of the agitator chamber 14. However, in other embodiments, such as those shown, the curvature of at least one of the upper, front or rear segments 42, 44, 46 may differ from the curvature of other segments 42, 44, 46. For example, upper segment 42 may have comparatively lower curvature and/or all three segments 42, 44, 46 may have different curvatures. Altering the curvatures of the segments 42, 44, 46, changes the magnitude of the lateral component forming the trajectory of a dirt particle, which, in turn, alters the path that the dirt particles traces across the interior surface 36 of the agitator chamber 14 from the suction opening 16 to the exhaust channel 22.

In another embodiment of the cleaner head 8, all three segments 42, 44, 46, while still divergently arranged, have zero curvature such that the cross-sectional area of the agitator chamber 14 increases continuously in a direction from the opposing ends 38, 40 to the exhaust channel 22. In this embodiment, the upper segment 42 would define, in cross-section, a flat surface upwardly inclined in a direction from the opposing ends 38, 40 of the agitator chamber 14 towards the exhaust channel 22, and the front and rear segments 44, 46 would also define flat surfaces in cross-section, at least one of which being outwardly inclined in the same direction. In this embodiment, there would be no variation in the increase of the cross-sectional area of the agitator chamber 14 in the direction of the exhaust channel 22, and so the lateral component added to the trajectory of the dirt particles would be the same regardless of the position at which they enter the agitator chamber 14.

It should also be pointed out that it is not necessary for the cross-sectional area of the agitator chamber 14 to increase along the entire length from its opposing ends 36, 38 to the exhaust channel 22 as is the case in the embodiments given above, and embodiments of the cleaner head 8 are envisaged in which the interior surface 36 of the agitator chamber 14 diverges part way between the opposing ends 38, 40 and the exhaust channel 22. Such an arrangement is in keeping with the previous embodiments of the cleaner head 8 so long as the divergence, and so the increase in the cross-sectional area of the agitator chamber 14, is in the direction from the opposing ends 38, 40 towards the exhaust channel 22 so as to encourage the dirt particles towards the exhaust channel 22.

Figure 10A:
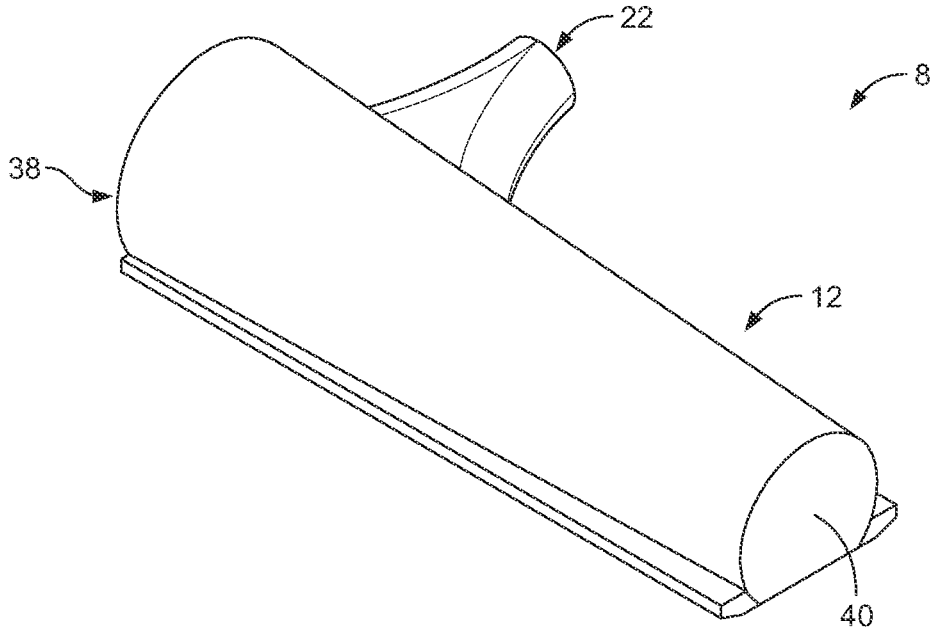
FIG. 10*a* is a front perspective view of another embodiment of a cleaner head.
Figure 10B:
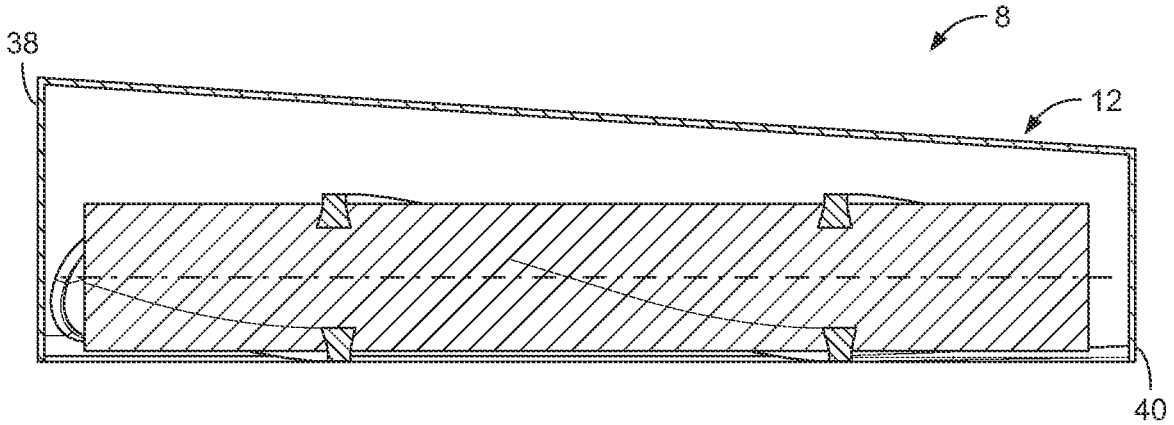
FIG. 10*b* is a sectional view of the cleaner head of FIG. 10*a;*
Figure 11A:
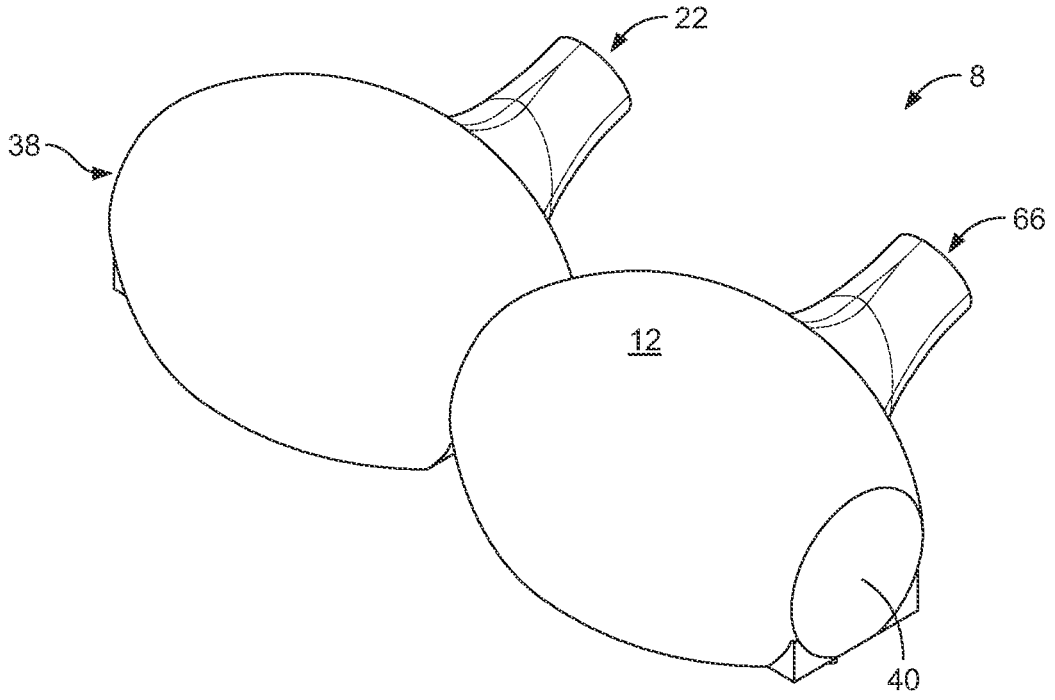
FIG. 11*a* is a front perspective view of another embodiment of the cleaner head.
Figure 11B:
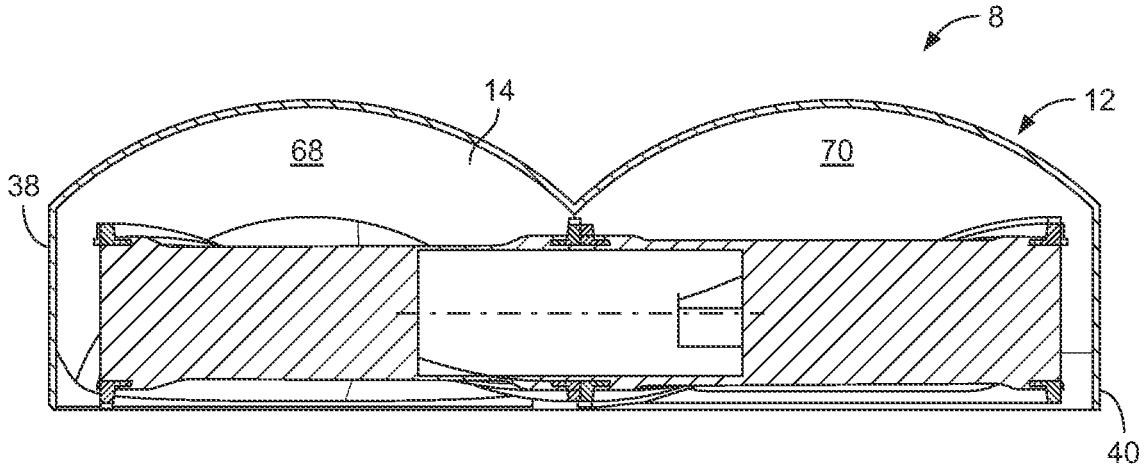
FIG. 11*b* is a sectional view of the cleaner head of FIG. 11*a;*

In all of the embodiments of the cleaner head 8 that so far have been provided, the exhaust channel 22 is centrally located with respect to the agitator chamber 14 but such an arrangement is not a requirement of the invention and embodiments of the cleaner head 8 are envisioned in which the exhaust channel 22 is not arranged centrally but is instead located on one side of the agitator chamber 14. Such embodiments include an agitator chamber 14 having an increasing cross-sectional area in directions from its opposing ends 38, 40 to the non-centrally located exhaust channel 22. In another embodiment shown in FIG. 10*a* and 10*b*, the exhaust channel 22 is laterally positioned at one side of the agitator chamber 14, adjacent one the opposing ends 38 and the main body 12 is configured such that the cross-sectional area of the agitator chamber 14 increases in a direction from the other opposing end 40 towards the exhaust channel 22, providing a spiral path to the exhaust channel 22 for dirt particles entering the agitator chamber 14. With reference to FIGS. 11*a* and 11*b*, in yet another embodiment, the cleaner head 8 further comprises a second exhaust channel 66 and the agitator chamber 14 defines two double-conical chambers 68, 70 in an open end-to-end arrangement. Each exhaust channel 22, 66 corresponds to one of the double-conical chambers 68, 70 such dirt particles entering one of the double-conical chambers 68 tend to spiral towards one of the exhaust channels 22 and dirt particles entering the other of the double-conical chambers 70 tend to spiral toward the other of the exhaust channels 66.

Figure 12:
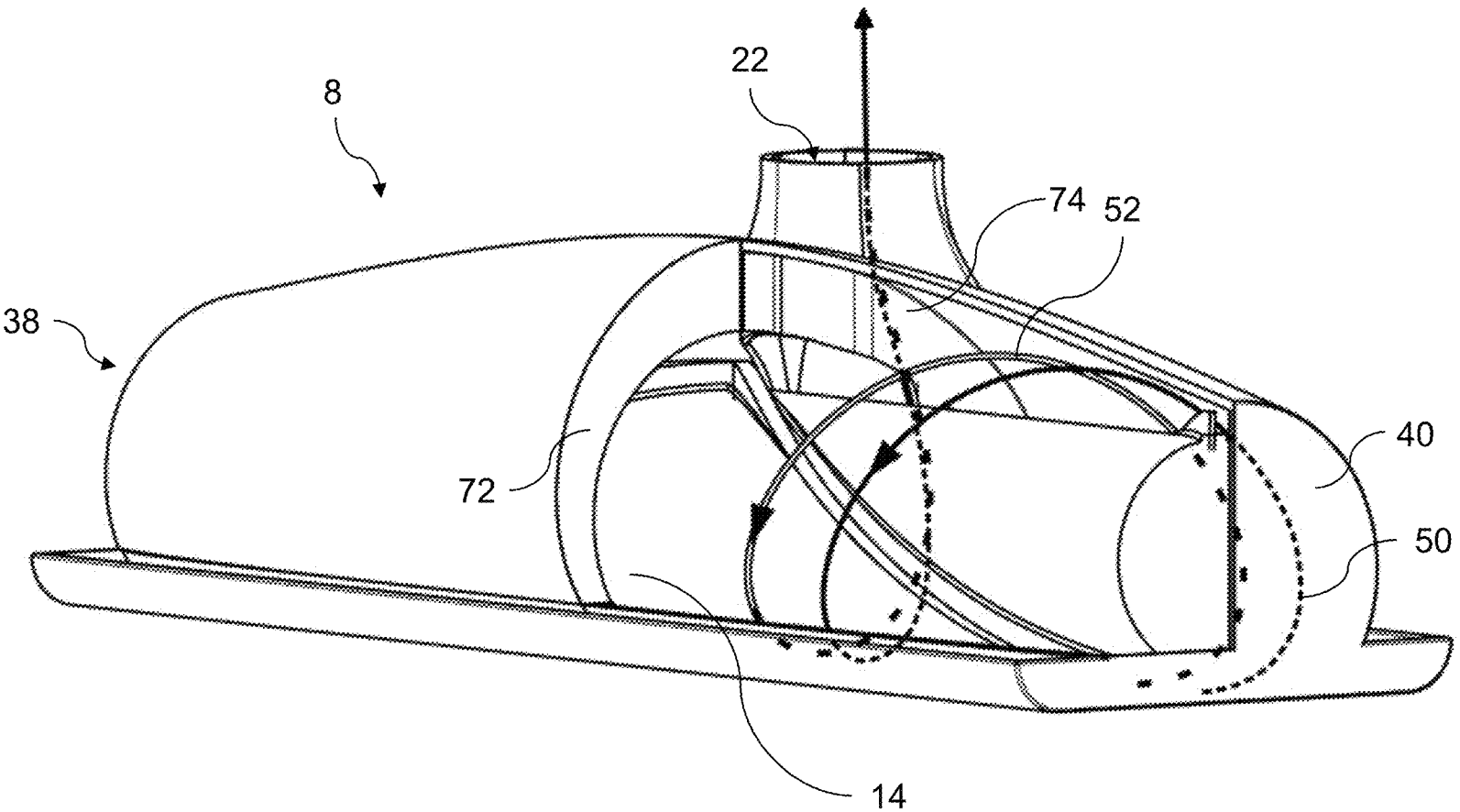
FIG. 12 is a front perspective view of the cleaner head of FIG. 1 with a right section of its main body cutaway showing an internal rib and duct; and, FIG. 13 is a front sectional view of the cleaner head of FIG. 12.
Figure 13:
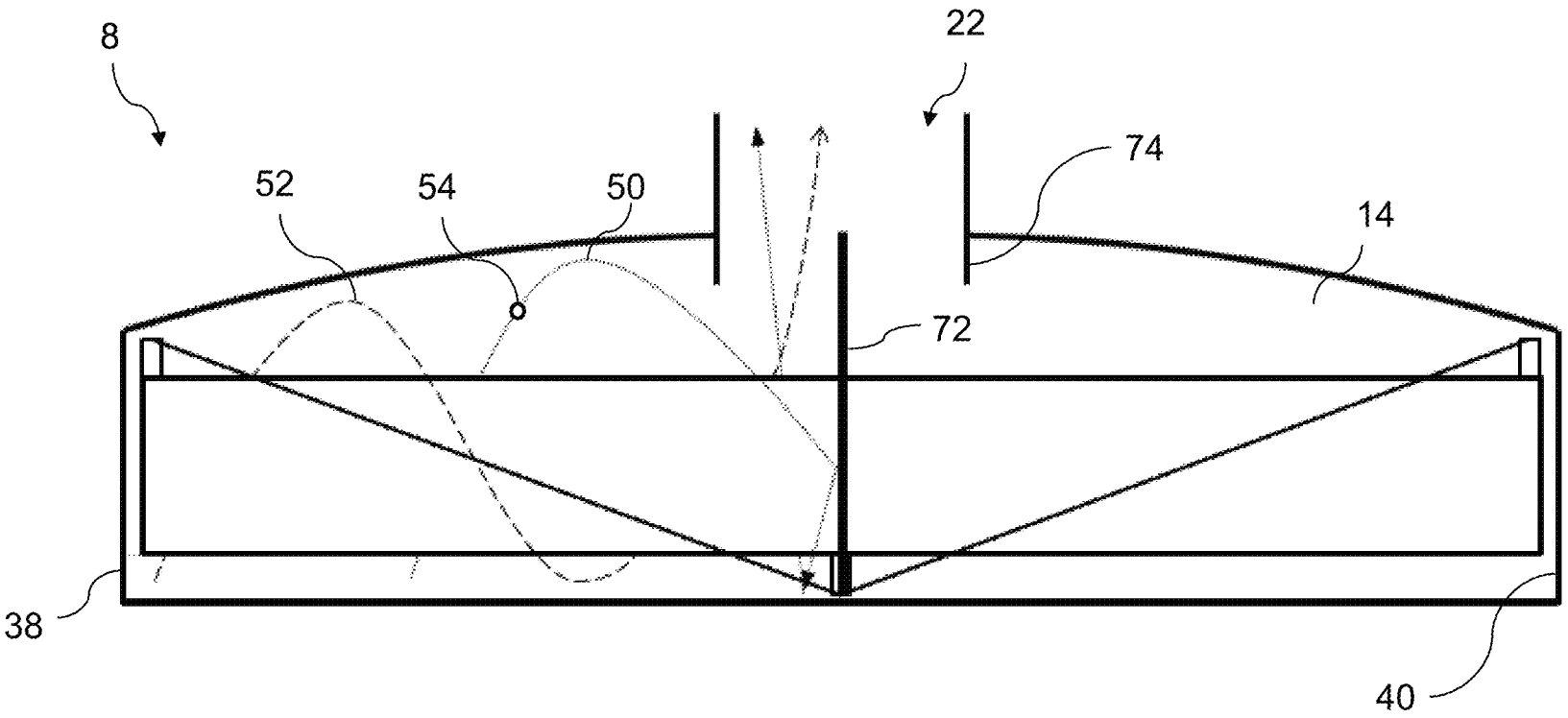

Turning to FIG. 12, the cleaner head 8 may further comprise a substantially circumferential rib 72 extending radially inward from the interior surface 36 of the agitator chamber 14. The rib 72 is laterally positioned within the agitator chamber 14 where the exhaust channel 22 meets the agitator chamber 14. In the example shown in FIG. 12, the exhaust channel 22 is centrally located with respect to the agitator chamber 14 and the rib 72 is positioned at the mid-point between the opposing ends 38, 40 of the agitator chamber 14. With reference to FIG. 13, the rib 72 acts as a barrier preventing dirt particles 54 that have entered one side of the agitator chamber 14 from traversing too far across the interior surface 36 of the agitator chamber 14 before they exit the agitator chamber 14 through the exhaust channel 22, as shown by trajectory 50. This minimises the number of times that the dirt particles can recirculate within the agitator chamber 14, reducing the risk of the dirt particles being returned to the floor surface. The cleaner head 8 may also comprise a duct 74 protruding from the exhaust channel 22 into the agitator chamber 14. This arrangement extends the exhaust channel 22 into the agitator chamber 14 to capture those dirt particles whose trajectories would have otherwise taken them outside the width of the exhaust channel 22, and so prevents their recirculation within the agitator chamber 14. It should be understood that although the rib and duct 72, 74 are shown together, they are functionally and structurally independent features that could be used individually or in combination. Moreover, the rib and duct 72, 74 are shown in a cleaner head 8 having an exhaust channel 22 extending from the agitator chamber 14 in a vertical direction, but the reader will understand that the rib and duct 72, 74 are not dependent on this configuration and could also be used in configurations in which the exhaust channel 22 do not extend vertically from the agitator chamber 14.

The cleaner heads in accordance with the present invention have been described with reference to particular embodiments thereof in order to illustrate the principles of operation. The above description is thus by way of illustration and directional references (including: upper, lower, upward, downward, left, right, leftward, rightward, top, bottom, side, above, below, front, middle, back, vertical, horizontal, height, depth width, and so forth) and any other terms having an implied orientation refer only to the orientation of the features as shown in the accompanying drawings. They should not be read to be requirements or limitations, particularly as to the position, orientation, or use of the invention unless specifically set forth in the appended claims. Connection references (e.g., attached, coupled, connected, joined, secured and the like) are to be construed broadly and may include intermediate members between a connection of elements and relative movement between elements. As such, connection references do not necessarily infer that two elements are directly connected and in fixed relation to each other, unless specifically set forth in the appended claims.

The invention claimed is:

1. A cleaner head for a vacuum cleaning appliance, the cleaner head comprising:

an agitator assembly comprising a cylindrical body configured to rotate about its longitudinal axis;

a main body defining an agitator chamber within which the agitator assembly is supported and a suction opening through which a portion of the agitator assembly engages a surface to be cleaned, the main body having opposing ends, wherein an uppermost interior surface of the main body defines an upper surface of the agitator chamber; and a first exhaust channel in fluid communication with the agitator chamber, wherein the main body is configured such that the cross-sectional area of the agitator chamber increases in a direction along the longitudinal axis from a first one of the opposing ends of the agitator chamber towards the first exhaust channel, the cross-sectional area being normal to the longitudinal axis, and wherein the cross-section normal to the longitudinal axis of the upper surface of the agitator chamber has circular curvature.

2. The cleaner head according to claim 1, wherein the cross-sectional area of the agitator chamber increases in directions along the longitudinal axis from both of the opposing ends of the agitator chamber towards the first exhaust channel.

3. The cleaner head according to claim 1, wherein the main body is configured such that the cross-sectional area of the agitator chamber increases continuously in the direction along the longitudinal axis from the first one of the opposing ends of the agitator chamber towards the first exhaust channel.

4. The cleaner head according to claim 1, wherein the main body is configured such that the cross-sectional area of the agitator chamber increases at a decreasing rate in the direction along the longitudinal axis from the first one of the opposing ends of the agitator chamber towards the first exhaust channel.

5. The cleaner head according to claim 1, wherein the main body is configured such that the cross-sectional area of the agitator chamber increases from at least one of the opposing ends to the first exhaust channel in the direction along the longitudinal axis.

6. The cleaner head according to claim 1, wherein the first exhaust channel extends tangentially from the agitator chamber.

7. The cleaner head according to claim 6, wherein the first exhaust channel is substantially perpendicular with respect to a horizontal plane.

8. The cleaner head according to claim 7, wherein the agitator assembly is configured to rotate about its longitudinal axis to sweep dirt particles from the surface to be cleaned towards a rear section of the agitator chamber with respect to a forward direction of the cleaner head during use, and wherein the first exhaust channel extends vertically from the rear section of the agitator chamber.

9. The cleaner head according to claim 6, wherein the first exhaust channel extends substantially parallel with respect to a horizontal plane.

10. The cleaner head according to claim 9, wherein the agitator assembly is configured to rotate about its longitudinal axis to sweep dirt particles from the surface to be cleaned towards a front section of the agitator chamber with respect to a forward direction of the cleaner head during use, and wherein the first exhaust channel extends rearward from an upper section of the agitator chamber.

11. The cleaner head according to claim 1, wherein the first exhaust channel is located at a mid-point between the opposing ends of the agitator chamber.

12. The cleaner head according to claim 1, further comprising a rib extending radially inward from an interior surface of the agitator chamber and laterally positioned within the agitator chamber at a point where the first exhaust channel and the agitator chamber meet.

13. The cleaner head according to claim 1, further comprising a duct protruding from the first exhaust channel into the agitator chamber.

14. The cleaner head according to claim 1, wherein the cleaner head further comprises a second exhaust channel, wherein the agitator chamber defines a first portion and a second portion in an end-to-end arrangement, and wherein the first exhaust channel corresponds to the first portion of the agitator chamber, and wherein the second exhaust channel corresponds to the second portion of the agitator chamber.

15. The cleaner head according to claim 14, wherein the first and second portions of the agitator chambers are in fluid communication with one another.

16. The cleaner head according to claim 14, wherein the first one of the opposing ends of the agitator chamber is an outermost end of the first portion of the agitator chamber, and wherein a second one of the opposing ends of the agitator chamber is an outermost end of the second portion of the agitator chamber.

17. The cleaner head according to claim 16, wherein the second portion of the agitator chamber has a cross-sectional area that increases in a direction from the second one of the opposing ends of the agitator chamber towards the second exhaust channel.

18. The cleaner head according to claim 17, wherein the cross-sectional area of the first portion of the agitator chamber decreases in a direction from the first exhaust channel towards the second portion of the agitator chamber, and wherein the cross-sectional area of the second portion of the agitator chamber decreases in a direction from the second exhaust channel towards the first portion of the agitator chamber.

19. A vacuum cleaning appliance comprising the cleaner head according to claim 1.

20. The cleaner head according to claim 1, wherein the first exhaust channel is arranged closer to a second one of the opposing ends of the agitator chamber than the first one of the opposing ends of the agitator chamber.

* * * * *